United States Patent [19]

Fischer

[11] 4,214,404

[45] Jul. 29, 1980

[54] STRUCTURAL ELEMENT OF AN ASSEMBLY KIT

[76] Inventor: Artur Fischer, Weinhalde 34, D-7244 Waldachtal 3 (Tumlingen), Fed. Rep. of Germany

[21] Appl. No.: 824,958

[22] Filed: Aug. 15, 1977

[30] Foreign Application Priority Data

Aug. 17, 1976 [DE] Fed. Rep. of Germany ..... 2636904

[51] Int. Cl.[2] ..... A63H 33/10

[52] U.S. Cl. ..... 46/26; 403/3

[58] Field of Search ..... 46/16, 17, 23, 26, 31, 46/28, 29, 30; 403/3

[56] References Cited

U.S. PATENT DOCUMENTS

| | | | |
|---|---|---|---|
| 2,895,753 | 7/1959 | Fentiman | 46/17 X |
| 3,451,158 | 6/1969 | Fischer | 403/3 X |
| 3,510,979 | 5/1970 | Fischer | 46/25 |
| 3,626,632 | 12/1971 | Bullock | 46/25 |
| 3,659,376 | 5/1972 | Fischer | 46/31 |
| 4,080,742 | 3/1978 | Osterried | 46/29 X |

FOREIGN PATENT DOCUMENTS

| | | | |
|---|---|---|---|
| 2229052 | 12/1973 | Fed. Rep. of Germany | 46/16 |
| 2506737 | 8/1976 | Fed. Rep. of Germany | 46/25 |

*Primary Examiner*—F. Barry Shay
*Attorney, Agent, or Firm*—Michael J. Striker

[57] ABSTRACT

A structural element of an assembly kit is proposed which is connectable with at least two further structural elements by respective differently dimensioned connecting elements each of which is associated with one of the further structural elements. The first-mentioned structural element has a body part having at least one undercut groove including two different undercut portions. One of the undercut portions of the undercut groove of the first-mentioned structural element is adapted to receive a section of the connecting element associated with one of the further structural elements, whereas the other different undercut portion of the groove of the first-mentioned structural element is adapted to receive a section of the connecting element associated with the other of the further structural elements. The portions of the groove of the first-mentioned structural elements may have a transverse dimension increasing in the direction towards an interior of this structural element.

7 Claims, 1 Drawing Figure

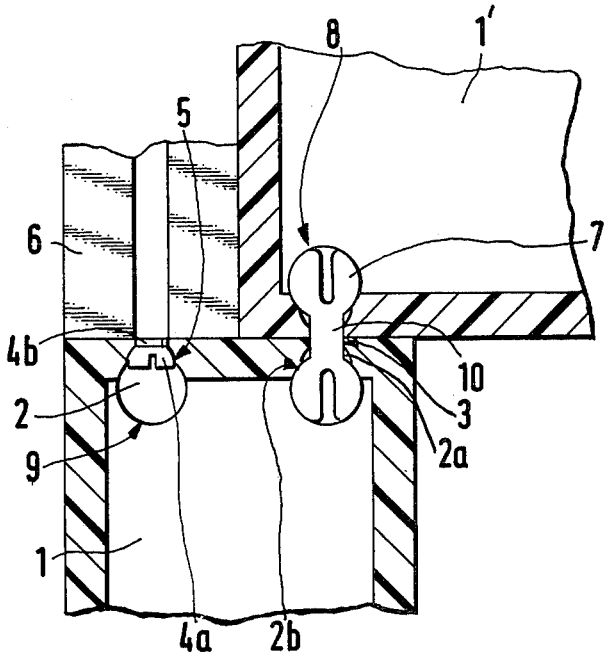
8
1'
5
6
7
4b
10
2
3
9
2a
1
4a
2b

STRUCTURAL ELEMENT OF AN ASSEMBLY KIT

BACKGROUND OF THE INVENTION

The present invention relates to a structural element of an assembly kit. More particularly, it relates to a structural element of an assembly kit which has at least one undercut groove adapted to receive a connecting element for connecting the above structural element with further structural elements.

Structural elements of assembly kits, having undercut grooves for receiving connecting elements so as to be connected with further structural elements have been proposed in the art. It has been found that it is advisable to provide connecting elements of different dimensions corresponding to manual dexterity of children of different age. It has been proposed to provide large structural elements associated with large connecting elements which are easier to manipulate and therefore are more suitable for playing of younger children, and also to provide small and more sophisticated structural elements having more diverse applications and associated with more accurate connecting elements.

When the child becomes older his manual dexterity increases so that he or she inevitably prefers playing with smaller and more sophisticated elements of assembly kits. The larger structural elements and the larger connecting elements become worthless for the child since he or she does not want to further use them. The known structural elements have no means enabling the older child to connect the small structural elements by small connecting elements which he or she prefers to play with, to the large structural elements with which he or she played earlier. This has the disadvantage that the above large structural elements and connecting elements are not used by the older children. On the other hand, the child cannot assemble such structure which is comprised of both large and small structural and connecting elements, and therefore would be of diverse shapes and dimensions.

SUMMARY OF THE INVENTION

Accordingly, it is an object of the present invention to provide a structural element of an assembly kit, which avoids the disadvantages of the known structural elements.

More particularly, it is an object of the present invention to provide such a structural element of an assembly kit, which enables a child to assemble structures of diverse shapes and dimensions.

Another object of the present invention is to provide such a structural element which is suitable for playing of both younger children who prefer large connecting elements, and older children who prefer small connecting elements.

A further object of the present invention is to provide a structural element which is connectable with further structural elements by means of connecting elements of different dimensions.

In keeping with these objects and with others which will become apparent hereinafter, one feature of the present invention resides, briefly stated, in a structural element of an assembly kit, whose body part has at least one groove including a first portion adapted to receive a section of a connecting element associated with one of further structural elements, and a differently dimensioned second portion adapted to receive a section of a differently dimensioned connecting element associated with another of the further structural elements. The second portion of the groove of the structural element may have a larger cross-section than the first portion thereof.

Such construction avoids the disadvantages of the prior art structural elements. When a child is younger and plays with large elements, he or she can connect the structural elements with one another by insertion of large connecting elements in the second large portions of the grooves thereof. When the child becomes older, he or she can connect the structural elements with one another by insertion of the small connecting elements in the first small portions of the grooves thereof. At the same time, he or she can connect the different structural elements by both the large and small structural elements. This can be performed by insertion of the small connecting elements in the small portion of the groove of the structural element so as to connect the latter with one of the further structural elements, and by further insertion of the large connecting elements in the large portion of the groove of the first-mentioned structural element so as to connect the latter with the other of the further structural elements. Thus, the older child can use not only small connecting elements but also large connecting elements which latter he or she would otherwise not use without the provision of the proposed specifically constructed groove. This provides a repeated use of the large connecting elements, on the one hand, and gives a possibility to assemble structures of different shapes and dimensions, on the other hand. This enables the large and relative crude connecting elements which are used by small children and handicapped children having relatively poor manual dexterity, to be combined with the connecting elements suitable for older children who play with the small and relatively sophisticated elements.

Another feature of the present invention is that the groove of the structural element has an axis, and the above first and second portions of the groove may be spaced from one another in the direction of the axis of the groove.

A further feature of the present invention is that the second portion of the groove may be spaced from the first portion thereof in the direction towards an interior of the structural element.

A still further feature of the present invention is that the portions of the groove of the structural element may have a transverse dimension which is increased in the direction towards an interior of the structural element.

An additional feature of the present invention is that in the case when the connecting elements of the further structural elements have a neck portion and a top portion, the groove of the structural element may have a neck portion which is dimensioned in accordance with the neck portions of the further structural elements connectable with the above first-mentioned structural element.

A still additional feature of the present invention is that in the above case, the first and second portions of the groove of the first-mentioned structural element may be each dimensioned so as to receive the top portion of the connecting element of the respective further structural element.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The single FIGURE of the drawing is a section of a structural element of an assembly kit, which is connected with two further structural elements by means of differently dimensioned connecting elements.

DESCRIPTION OF A PREFERRED EMBODIMENT

As shown in the single FIGURE of the drawing, a hollow structural element 1 is connected with a second hollow structural element 1' and with a substantially solid structural element 6.

The solid structural element 6 is smaller than the hollow structural elements 1 and 1' and is associated with a connecting element which is identified in toto by reference numeral 5. The connecting element 5 is substantially small and has a top section 4a and a neck section 4b connected with one another. The connecting element 5 of the solid structural element 6 is formed as an undercut element.

The second hollow structural element 1' has a dimension exceeding the dimension of the solid structural element 6 and is associated with a connecting element identified in toto by reference numeral 8. The connecting element 8 also has a dimension exceeding the dimension of the connecting element 5 of the solid structural element 6. It has two elongated top sections 7 connected with one another by an intermediate neck section 10. A width of the neck section 10 of the connecting element 8 of the hollow structural element 1' corresponds to the width of the neck section 4b of the connecting element 5 of the solid structural element 6.

The hollow structural element 1 with which the structural elements 1' and 6 are to be connected, has two undercut grooves 2. Each groove has two portions 2a and 2b spaced from one another in the direction of an axis of the groove 2, so that the portion 2a of the latter is spaced from the portion 2b in the direction towards an interior of the hollow structural element 1. The portion 2a which is located closer to outer lips 3 of the groove 2 is so formed as to correspond to the small top section 4a of the connecting element 5 of the solid structural element 6, whereas the portion 2b which is located closer to the interior of the hollow structural element 1 is formed so as to correspond to the large top section 7 of the connecting element 8 of the second hollow structural element 1'. It is understood that the portion 2b of the groove 2 of the hollow structural element 1 has dimensions exceeding the dimensions of the portion 2a thereof. In the region of side walls of the hollow structural element 1 the portion 2b of the groove 2 forms a circular recess 9 having a cross-section which corresponds to the cross-section of the section 7 of the connecting element 8 of the second hollow structural element 1'. The portion 2a and 2b of the groove 2 are formed as undercut portions and have a cross-section increasing in the direction towards the interior of the hollow structural element 1.

When the hollow structural element 1 has a groove which is formed in accordance with the present invention, the further structural elements can be connected with the former both by the small connecting element and by the large connecting element. The second hollow structural element 1' may be connected to the hollow structural element 1 by insertion of the large connecting element 8 associated with the former, in the portion 2b of any groove 2 of the latter. Similarly to this, the solid structural element 6 can be connected to the hollow structural element 1 by insertion of the small connecting element 5 of the former in the portion 2a of any groove 2 of the latter. On the other hand, both structural elements 1' and 6 can be simultaneously connected to the hollow structural element 1 by insertion of the respective connecting elements 5 and 8 in the portions 2a and 2b, respectively, of the respective one of the grooves 2.

It will be understood that each of the elements described above, or two or more together, may also find a useful application in other types of constructions differing from the types described above.

While the invention has been illustrated and described as embodied in a structural element of an assembly kit, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An assembly kit, comprising a first structural element associated with a first connecting element having a smaller transverse cross section; a second structural element associable with a second connecting element having a greater transverse cross-section; and a hollow third structural element to which said first and second structural elements are detachably connected, said third structural element having at least one undercut groove including a first undercut portion having a smaller transverse cross-section so that said first connecting element can be received in said first undercut portion of said groove to thereby accomplish the aforesaid connection of said first structural element to said third structural element, and a second undercut portion having a greater cross-section so that said second connecting element after detachment of the aforesaid connection of said first structural element to said third structural element can be alternately received in said second undercut portion of the same groove to thereby alternately connect said second structural element to said third structural element, said second undercut portion of said groove being open into the hollow of said third structural element.

2. An assembly kit, comprising a first structural element associated with a first connecting element having a smaller transverse cross-section; a second structural element associable with a second connecting element having a greater transverse cross-section; and a third structural element to which said first and second structural elements are detachably connected, said third structural element having at least one undercut groove including a first undercut portion having a smaller transverse cross-section so that said first connecting element can be received in said first undercut portion of said groove to thereby accomplish the aforesaid connection of said first structural element to said third structural element, and a second undercut portion spaced relative to said first undercut portion in the direction toward an interior of said third structural element and having a greater cross-section so that said second connecting element after detachment of the aforesaid connection of said first structural element to said third structural element can be alternately received in said second undercut portion of the same groove to thereby alternately connect said second structural element to said third structural element.

3. An assembly kit as defined in claim 2, wherein said groove has an axis, said portions of said groove being spaced from one another in the direction of said axis thereof.

4. An assembly kit as defined in claim 2, wherein said first and second portions of said groove each have a transverse dimension increasing in the direction towards an interior of said structural element.

5. An assembly kit as defined in claim 2, wherein each of said connecting elements has a neck section and a top section, the top section of said first connecting element having the smaller transverse cross section whereas the top section of said second connecting element has the greater transverse cross section, said groove including a neck portion dimensioned to receive the neck portion of each of the connecting elements.

6. An assembly kit as defined in claim 5, wherein said first and said second portions of said groove each are dimensioned for receiving the top section of the first and second connecting element, respectively.

7. An assembly kit as defined in claim 2, wherein said third structural element has a second such undercut groove including another such first and second undercut portion so that said first connecting element can be received in said first undercut portion of one of said undercut grooves whereas said second connecting element can be simultaneously received in said second undercut portion of the other undercut groove whereby said first and second structural elements can be simultaneously connected to said third structural element.

* * * * *